US006870553B2

(12) United States Patent
Kondo et al.

(10) Patent No.: US 6,870,553 B2
(45) Date of Patent: Mar. 22, 2005

(54) DRIVE CIRCUIT TO BE USED IN ACTIVE MATRIX TYPE LIGHT-EMITTING ELEMENT ARRAY

(75) Inventors: Shigeki Kondo, Hiratsuka (JP); Hiroyuki Nakamura, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 332 days.

(21) Appl. No.: 10/247,564

(22) Filed: Sep. 20, 2002

(65) Prior Publication Data

US 2003/0020705 A1 Jan. 30, 2003

Related U.S. Application Data

(63) Continuation of application No. PCT/JP02/02471, filed on Mar. 15, 2002.

(30) Foreign Application Priority Data

Mar. 21, 2001 (JP) ..... 2001-080506
Mar. 22, 2001 (JP) ..... 2001-081880

(51) Int. Cl.[7] ..... G09G 3/12

(52) U.S. Cl. ..... 345/690; 345/76; 345/77; 345/204; 345/205; 345/206; 345/210; 345/214; 315/169.1; 315/169.3

(58) Field of Search ..... 345/76, 77, 204, 345/205, 206, 210, 214, 690; 315/169.1, 169.3

(56) References Cited

U.S. PATENT DOCUMENTS

| | | | | |
|---|---|---|---|---|
| 4,602,192 A | * | 7/1986 | Nomura et al. | 315/169.3 |
| 4,799,224 A | | 1/1989 | Bottacchi et al. | 372/38 |
| 5,006,732 A | | 4/1991 | Nakamura et al. | 307/473 |
| 5,349,595 A | | 9/1994 | Ogawa et al. | 372/38 |
| 5,723,950 A | * | 3/1998 | Wei et al. | 315/169.3 |
| 5,869,949 A | | 2/1999 | Nishikawa et al. | 320/101 |

* cited by examiner

*Primary Examiner*—Bipin Shalwala
*Assistant Examiner*—Vincent E. Kovalick
(74) *Attorney, Agent, or Firm*—Fitzpatrick, Cella, Harper & Scinto

(57) ABSTRACT

A light-emitting element and a picture signal current supply circuit are formed near each of the crossings of scan lines and signal lines and a charging circuit is provided to precharge the electric capacitance of the light-emitting element with an electric load that is lower than the light-emitting threshold level of the element. With this arrangement, the time that needs to be spent before the light-emitting element, which is an organic EL element, starts emitting light is reduced so that it can be driven at high speed to display an image with tones.

12 Claims, 5 Drawing Sheets

DRIVE CIRCUIT TO BE USED IN ACTIVE MATRIX TYPE LIGHT-EMITTING ELEMENT ARRAY

This application is a continuation of International Application No. PCT/JP02/02471 filed on Mar. 15, 2002, which claims the benefit of Japanese Patent Application Nos. 080506/2001 and 081880/2001.

BACKGROUND OF THE INVENTION

1. Field of the Invention

This invention relates to a drive circuit to be used in an active matrix type light-emitting element array for driving and controlling an emission type element such as electroluminescent (to be referred to as "EL" hereinafter") element or light-emitting diode (to be referred to as "LED" hereinafter) and also to an active matrix type display panel realized by using such a drive circuit.

2. Related Background Art

Display devices adapted to display characters and images by means of a dot matrix formed by arranging light-emitting elements such as organic or inorganic EL elements or LEDs are currently popularly being used in television sets, mobile terminals and other applications.

Particularly, display devices comprising emission type elements are attracting attention because, unlike display devices utilizing liquid crystal, they have a number of advantages including that they do not require a backlight for illumination and provide a wide view angle. Above all, display devices referred to as active matrix type devices that are realized by combining transistors and light-emitting elements and adapted to be operated in a drive mode referred to as static drive have been drawing attention because they provide remarkable advantages including high brightness, high contrast and high definition if compared with display devices that operate on a time division drive basis in a simple matrix drive mode.

Also for organic EL elements, known systems that have hitherto been used to provide displayed images with tones, including the analog gray-scale system, the area gray-scale system and the pulse width modulation (PWM) system, can be used as in the case of other known light-emitting elements.

(1) Analog System

The analog gray-scale system will be described by way of a light-emitting element that is adapted to be driven by using an active matrix system. FIG. 7 of the accompanying drawings schematically shows a drive circuit to be used in a display device in which each pixel is provided with a pair of thin film transistors (to be referred to as TFTs hereinafter), as a simplest one. In FIG. 7, there are shown an organic EL element 11, TFTs 12 and 13, a scan line 15, a signal line 14, a power supply line 17, the ground potential 18 and a memory capacitance 19.

The operation of the drive circuit will be described below. When the TFT 12 is turned ON by way of the scan line 15, the picture data voltage from the signal line 14 is accumulated in the memory capacitance 19 and continues to be applied to the gate electrode of the TFT 13 even after the scan line 15 is turned off to turn off the TFT 12.

On the other hand, the TFT 13 has its source electrode connected to the power supply line 17, its drain electrode connected to the first electrode of the light-emitting element 11 and its gate electrode connected to the drain electrode of the TFT 12 so that the picture data voltage is input to the gate electrode of the TFT 13. The quantity of the electric current between the source electrode and the drain electrode of the TFT 13 is controlled by said picture data voltage. The organic EL element 11 is arranged between the power supply line 17 and the ground potential 18 and emits light as a function of said quantity of electric current.

The quantity of the electric current that flows depends on the gate voltage of the TFT 13 and, with the analog gray-scale system, a rising region (to be referred to as "saturated region" here for the sake of convenience) of the source current characteristic relative to the gate voltage (Vg-Is characteristic) is used for changing the electric current characteristic in an analog fashion so as to change the brightness of emitted light.

As a result, the brightness of light emitted from the organic EL element 11 that operates as light-emitting element is controlled so as to display an image with tones. This system of expressing tones is referred to as analog gray-scale system because it uses an analog picture data voltage.

Currently available TFTs include those of the amorphous silicon (a-Si) type and those of the polycrystalline silicon (polysilicon or p-Si) type, of which polycrystalline silicon TFTs are in the mainstream because they show a high mobility and can be downsized in addition to that the process of manufacturing polycrystalline silicon TFTs can be conducted at low temperature due to the recent advancement of laser processing technology. However, generally, polycrystalline silicon TFTs are apt to be affected by the crystal grain boundaries thereof and their Vg-Is current characteristic can vary remarkably among TFT elements particularly in the saturated region. In other words, even if a uniform video signal voltage is applied to the pixels of the display device, an uneven image can be displayed.

Furthermore, most TFTs are currently being used simply as switching elements. More specifically, a gate voltage considerably higher than the threshold voltage of those transistors is applied to them so that the transistors are operated in a region of the characteristic curve where the drain current is proportional to the source voltage (to be referred to as "linear region" hereinafter) and hence their performances are not significantly affected by the varying electric characteristics in the saturated region. However, if polysilicon TFTs are operated in the saturated region in order to adopt the analog gray-scale system, the display performance of the display device can become unstable as the operation of the TFTs are affected by the varying electric characteristics.

Additionally, with the analog gray-scale system, the picture data signal needs to be changed as a function of the brightness-voltage characteristic of the organic EL element. However, since the voltage-current characteristic of the organic EL element is a non-linear characteristic like that of a diode, the voltage-brightness characteristic curve also shows a sharp rise as that of a diode. Therefore, the picture data signal has to be subjected to gamma correction to make the drive control system a complex one.

(2) Area Gray-scale System

The area gray-scale system is proposed in papers AM-LCD2000, AM3-1. It is a system of dividing each pixel into a plurality of sub-pixels so that each sub-pixel can be turned ON and OFF and the gray level of each pixel may be defined by the total area of the sub-pixels that are ON. FIG. 8 of the accompanying drawings shows a plan circuit configuration when a pixel is divided into six sub-pixels.

With this system of utilizing organic EL elements, TFTs need to operate simply as switching elements because each pixel is simply controlled so as to become ON or OFF and not required to provide any gray levels so that a gate voltage that is much higher than the threshold voltage is applied to exploit a region of the characteristic curve where the drain current is proportional to the source voltage in order to stabilize the light-emitting characteristic. In other words, with this system, each light-emitting element emits light to show a constant degree of brightness and the gray level is controlled by the area of the sub-pixels that are driven to emit light.

However, this gray-scale system can provide only a digital gray-scale that depends on the method selected for dividing the display area to produce sub-pixels and the number of sub-pixels has to be increased by reducing the area of each sub-pixel when raising the gray-scale level. Even if transistors are downsized by using polycrystalline silicon TFTs, the area of the transistor arranged in each pixel comes to occupy the corresponding light-emitting area to a large extent to consequently reduce the aperture ratio of the pixel so that by turn the brightness of the entire display panel is inevitably reduced. In other words, the gray-scale level is a tradeoff for the aperture ratio and therefore it is difficult to improve the gray-scale level.

(3) Pulse Width Modulation System

Finally, the pulse width modulation system is a system of controlling the gray-scale by way of the light emitting time period of each organic EL element as reported in 2000 SID 36.4L.

FIG. 9 is a circuit diagram of a pixel of a known display panel that employs the pulse width modulation system. In FIG. 9, there are shown an organic EL element 11, TFTs 10, 12, 13, a scan line 15, a signal line 14, a power supply line 17, the ground potential 18, a memory capacitance 19 and a reset line 16.

With the pulse width modulation system that is used with such a circuit configuration, the organic EL element 11 emits light to the highest brightness due to the voltage applied from the power supply line 17 when the TFT 13 is turned ON and then it repeatedly turned ON and OFF within the time period of a field by the TFT 10 in an appropriate manner so that the gray-scale is expressed by the time of light emission.

With this system, a field is divided into a plurality of sub-fields and the time period of light emission is regulated by selecting one of the time periods provided for light emission. For example, when 8 bits (256 gray levels) are used to express gray-scale, the time period of light emission is determined by selecting one of eight sub-field periods defined by the ratio of 1:2:4:8:16:32:64:128 for light emission. Since emission/non-emission in a sub-field is selected immediately before the time period of the sub-field, a time period for addressing the scan lines of the entire pixels is required for each selection. After the addressing time period is over, the entire surface of the display panel is driven to emit light typically by changing the voltages of all the power supply lines 17.

In other words, no image is displayed during each addressing time period. Thus, when N bits are used to express gray-scale, the effective light-emitting time period in a field is (1 field time period)−(addressing time period of an image×N).

Therefore, the effective light-emitting time period is relatively reduced to by turn reduce the quantity of light of the display panel emitted in a unit time that is perceived by the viewer.

Thus, it is necessary to increase the quantity of emitted light of the entire field by increasing the quantity of emitted light per sub-field. Then, the brightness of emitted light of each individual light-emitting element has to be raised at the cost of reducing the service life of the light-emitting element. Additionally, while an ordinary liquid crystal display (LCD) requires only a single addressing operation per field, this arrangement requires as many addressing operations as the number of bits that are used for gray-scale and hence an addressing circuit that operates at a very high speed.

Therefore, this invention is intended to provide a novel drive circuit to be used in an active matrix type light-emitting element array in order to stably display images with tones by dissolving the above identified problems for driving a light-emitting element.

As pointed out above, a number of problems have to be dissolved before driving a light-emitting element array by using TFTs. Particularly, for a TFT to be turned ON and OFF in a very short period of time, it is necessary to utilize a region of the drive characteristic curve of the TFT that is closely related to transient response. Then, the variances of the characteristics of the TFTs being used for the light-emitting element array significantly affect its performance.

A solution to this problem is to prolong the operation time of the TFT as much as possible and another is to reduce the quantity of electric current that is supplied to turn ON and OFF the TFT.

Firstly, the electric conditions of a light-emitting element will be discussed briefly.

An organic EL element has a configuration realized by laying organic layers including a light-emitting layer, an electron transporting layer and a hole transporting layer between an anode and a cathode. A junction capacitance is inevitably produced along each of the junction interfaces of those materials having respective energy band structures that are different from each other. Since each of the film layers has a film thickness of about 100 nm and the overall electric capacitance between the electrodes is about 25 nF/cm$^2$, a pixel of 100 $\mu$m×100 $\mu$m has a capacitance of about 2.5 pF, which is very large if compared with a liquid crystal element.

A number of light-emitting elements equal to the number of pixels are arranged in parallel for a matrix arrangement to provide a large load to the external drive circuit. Additionally, the signal output from the external drive circuit is accompanied by a distortion made to the signal waveform as a function of the capacitance of the element and the resistance of the wiring, which by turn reduces the effective time period during which the voltage is applied to the light-emitting element.

The inventors of the present invention found that the time period required for electrically charging the light-emitting element influences the effective response speed of the element and tried to reduce the influence.

Assume an instance of driving a light-emitting element by means of an electric current flowing from a power source. The electric current produces the potential difference between the electrodes only after charging the electric capacitance and an injection of electrons takes place to give rise to an emission of light when it gets to a predetermined threshold voltage. The time required for charging the electric capacitance can be estimated in a manner as described below.

The drive electric current necessary for achieving the highest light-emitting efficiency for an organic EL element is about 2 to 3 $\mu$A when the pixel size is 100 $\mu$m×100 $\mu$m.

For realizing an 8-bit gray-scale by means of the analog gray-scale system, the lowest electric current is 2 to 3 $\mu A/2^8 \cong 8$ to 12 nA.

Now, one can estimate the time required for charging the electric capacitance by drawing an electric current of 8 to 12 nA from a current source in order to produce the lowest possible brightness for emission of light.

Generally, the light-emitting threshold voltage of an organic EL element is 2 to 3 V and from the relationship of electric capacitance $C$×threshold voltage $Vth$=smallest electric current Imin×time $t$, the time is estimated as follows:

$$\text{time } t = 2.5\ \text{pF} \times 2 \text{ to } 3\ \text{V}/8 \text{ to } 12\ \text{nA}$$

$$\cong 420\ \mu\text{s to } 940\ \mu\text{s}$$

Take a popular display device of the VGA category having about 400 scanning lines for example. Since the selection time consumed per scanning line is about 30 $\mu$s and hence an image display device of the VGA category cannot emit light of the darkest state within such a time so that the estimated time is not satisfactory for a display device.

On the other hand, the pulse width modulation system is adapted to produce a gray-scale by turning ON/OFF each light-emitting element for a light-emitting time period of the highest brightness within a frame. Now, consider an instance of pulse width modulation that produces the lowest brightness for emitted light. If a field is 60 Hz, the shortest ON time for achieving an 8-bit gray-scale is $$1/60/2^8 \cong 65\ \mu\text{s}.$$

If the pixel size is same as the above cited value and the largest current is drawn from the current source, the time t that needs to be consumed until the emission of light starts is $$t = 2.5\ \text{pF} \times 2 \text{ to } 3\ \text{V}/2 \text{ to } 3\ \mu\text{A}$$

$$\cong 1.7 \text{ to } 3.75\ \mu\text{s}.$$

The obtained value indicates that the time period of light emission is not significantly affected.

However, efforts are being paid to improve the light-emitting efficiency for the purpose of prolonging the service life and reducing the power consumption rate. The target in the future will be achieving the highest efficiency at 100 to 200 nA.

Then, the time required to be consumed until the emission of light is $$t = 25 \text{ to } 75\ \mu\text{s}$$

so that it cannot be expected to achieve emission of light with the lowest brightness by means of the pulse width modulation system.

SUMMARY OF THE INVENTION

In view of the above described circumstances, it is therefore the object of the present invention to drive an organic EL element at high speed and realize an excellent gray-scale so as to provide a drive circuit that can be used in a high quality active matrix type light-emitting element array as well as an active matrix type display panel comprising such a drive circuit.

To achieve the above object, the present invention adopts a drive method of providing each light-emitting element with an advance charging circuit for charging the electric capacitance in advance so as to charge the electric capacitance in advance relative to the scan selection time and charge an electric load greater than the light emission threshold voltage in the next selection time.

According to the invention, the above object is achieved by providing a drive circuit to be used in a light-emitting element array having scan lines and signal lines arranged in a matrix form on a substrate, at least a light-emitting element and a picture signal electric current supply circuit for causing the light-emitting element to emit light being provided near each of the crossings of the scan lines and the signal lines, the drive circuit comprising:

a charging circuit adapted to apply a voltage and/or an electric current to the light-emitting element, the voltage being lower than a light-emitting threshold voltage of the light-emitting element, the electric current being lower than a lowest brightness producing electric current of the light-emitting element. Note that either a voltage lower than the light-emitting threshold voltage of the light-emitting element or an electric current lower than the lowest brightness producing electric current of the light-emitting element or both of them may be applied.

Preferably, the voltage lower than a light-emitting threshold voltage is a partial voltage of a power source voltage produced by division by a resistance element or a switching element and the light-emitting element.

Preferably, the electric current lower than the lowest brightness producing electric current is produced by a limiting resistance of a resistance element or a switching element relative to a power source voltage.

Preferably, charging operation of the charging circuit is conducted in a non-light-emitting period of the light-emitting element.

Preferably, the charging circuit is formed by using a switching element and a reference voltage source.

Preferably, the picture signal current supply circuit includes a source follower circuit or a current mirror circuit formed by using a thin film transistor.

BRIEF DESCRIPTION OF THE DRAWINGS

In FIGS. 1A and 1B, reference numerals 1 and 2 denote respectively an organic EL element (light-emitting element) and a resistance element (or TFT), whereas reference numerals 6, 7 and 8 denote respectively a picture signal current supply circuit, a power supply line and the ground potential.

In FIG. 3, reference numerals 1, 2 and 4 denote respectively an organic EL element, a TFT and a signal line, whereas reference numerals 6, 7, 8 and 9 denote respectively a picture signal current supply circuit, a power supply line, the ground potential and a reference power source.

Figure 1A:
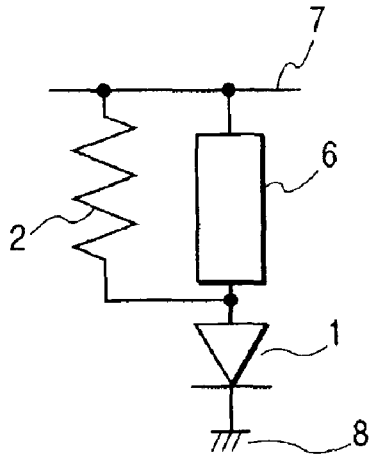
FIGS. 1A and 1B are circuit diagrams of two alternatives of the first embodiment of drive circuit to be used in an active matrix type light-emitting element array according to the invention.

6, reference numerals 1, 2, 3 and 4 denote respectively an organic EL element, a TFT, a scan line and a signal line for driving the TFT 2, whereas reference numerals 5, 6, 8 and 9 denote respectively a picture signal line, a picture signal current supply circuit for addressing a pixel and driving the light-emitting element, a power source for the light-emitting element and a reference power source.

Figure 7:
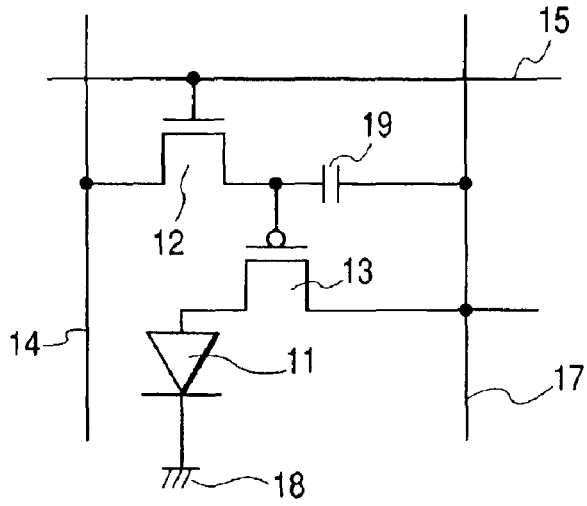

FIG. 7 is a circuit diagram of a drive circuit using a known analog gray-scale system.

Figure 8:
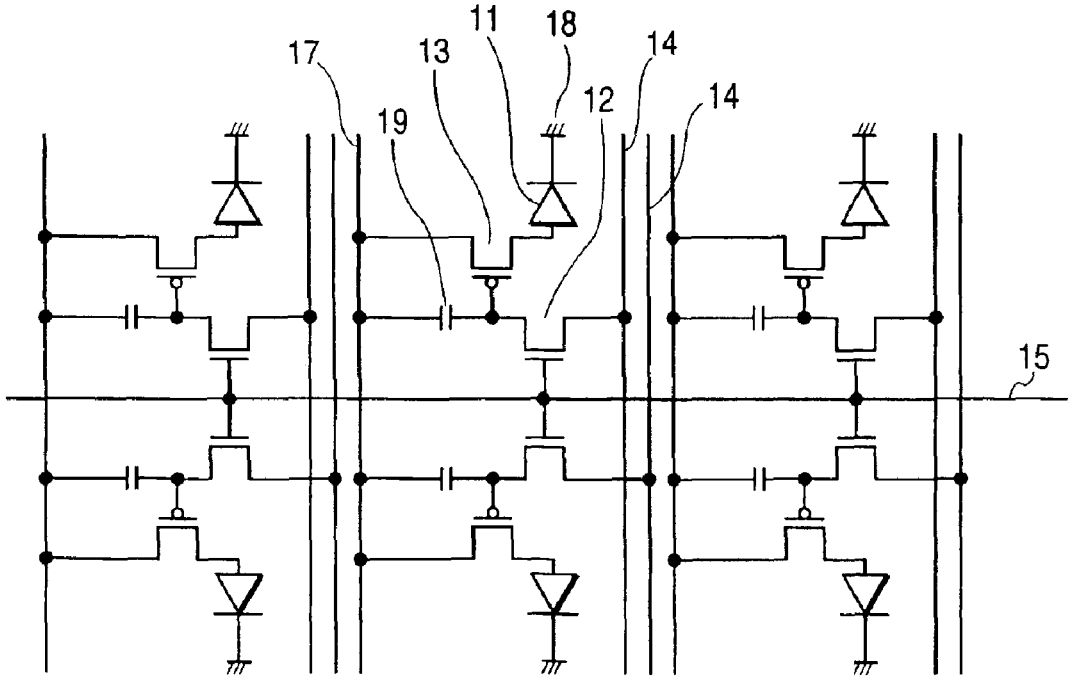

FIG. 8 is a circuit diagram of a drive circuit using a known area gray-scale system.

Figure 9:
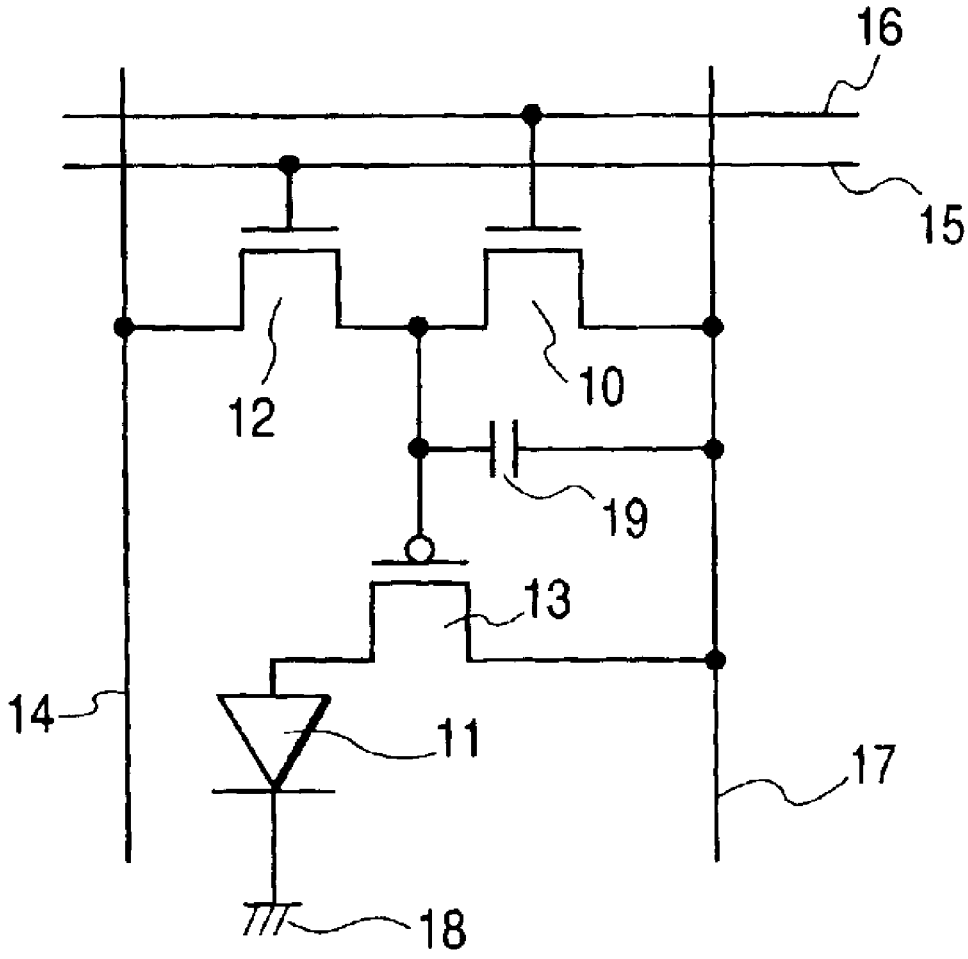

FIG. 9 is a circuit diagram of a drive circuit using a known pulse width modulation system.

DESCRIPTION OF THE PREFERRED EMBODIMENTS

Now, the present invention will be described in greater detail by referring to the accompanying drawings that illustrate preferred embodiments of the invention, although the present invention is by no means limited thereto.

Embodiment 1

Figure 1B:
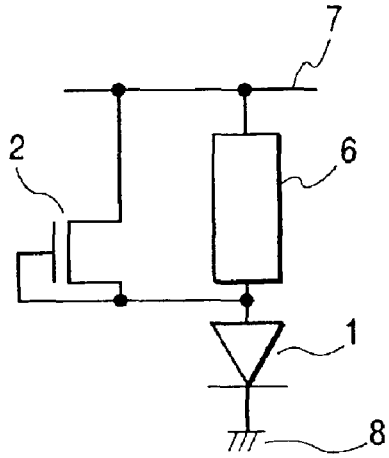

FIGS. 1A and 1B are circuit diagrams of two alternatives of the first embodiment of drive circuit to be used in an active matrix type light-emitting element array according to the invention. In FIG. 1A, a resistance element 2 is connected between a power supply line 7 and a light-emitting element 1, whereas the resistance element is replaced by a thin film transistor (TFT) in FIG. 1B.

The drive circuit of this embodiment is so designed as to be used in an active matrix type light-emitting element array comprising scan lines and signal lines (not shown in FIGS. 1A and 1B) arranged to form a matrix on a substrate and unit pixels arranged near the respective crossings of the scan lines and the signal lines, each unit pixel having a resistance element 2, a picture signal current supply circuit 6 and a light-emitting element 1 adapted to be caused to emit light by the picture signal current.

The light-emitting element 1 is realized by using an organic EL element that is made of a plurality of materials and has at least a light-emitting layer. It is provided with a functional feature of precharging the electric capacitance produced by the component materials of the organic EL element with an electric charge that is less than the light-emitting threshold level.

The electric capacitance is formed by combining the junction capacitances existing along the interfaces of the different materials of the light-emitting layer, the electron transporting layer and so on of the organic EL element.

Referring to FIG. 1A, while one of the electrodes of the resistance element 2 is connected to the power supply line 7, the circuit configuration is not limited to that of FIG. 1A and may alternatively be connected to some other power source.

A power supply circuit 6 for supplying a picture signal current is connected in parallel with the resistance element 2 between the power supply line 7 and the ground potential 8. The light-emitting element is serially connected to the power supply circuit 6 and the resistance element 2 between the line 7 and the ground potential 8.

A high level voltage is applied to the power supply line to drive the light-emitting element to emit light during the time period when the light-emitting element is selected, whereas a low level voltage is applied to the power supply line during the time period when the light-emitting element is not selected. During the latter time period, the resistance element 2 and the light-emitting element 1 are provided with respective voltages due to division by DC resistance so that the light-emitting element is electrically charged. The voltage applied to the light-emitting element needs to be lower than the light-emitting threshold voltage of the element. In reality, while the resistance of the resistance element is considerably high because the conductance of the light-emitting element is considerably small for a voltage lower than the light-emitting threshold voltage, it is not difficult to determine the resistance level.

It is also possible to apply a voltage higher than the light-emitting threshold voltage and suppress the light-emitting element from emitting light by limiting the electric current flowing to it. For instance, when expressing 256 gray levels, a limiting gray levels resistance that can allow only a fraction of the electric current that produces the lowest brightness for emitted light may be provided. Then, only a very weak electric current flows to the light-emitting element to precharge the latter but the viewer does not recognize that the light-emitting element is actually emitting light. This technique can effectively precharge the light-emitting element much more than the above described one.

If the voltage of the light-emitting element fluctuates, the electric capacitance continues to be electrically charged by a voltage lower than the threshold voltage because the electric current is supplied always by way of the resistance.

While a value of about $9\times10^8\ \Omega$ is selected for the resistance of the resistance element of this embodiment, the resistance may be selected appropriately to any other level by considering the manufacturing process and a necessary margin provided that the voltage applied to the light-emitting element is lower than the light-emitting threshold voltage due to division by resistance.

Since the power supply line 7 is commonly used by the light-emitting element and the resistance element in this embodiment, it is not necessary to provide a separate power supply line for precharging.

If the light-emitting threshold voltage of the organic EL element is Vth and the electric capacitance of the light-emitting element is C, while the light-emitting current is I and the voltage selected for precharging is Vr for the drive circuit having the above described configuration, it is only necessary to charge the light-emitting element for the difference between the threshold voltage and the precharging voltage from the point of view of the drive circuit. Thus, the time t that is consumed before the start of light emission is expressed by the following equation.

$$t=(Vth-Vr)\times C/I$$

Assume that the light-emitting current is 100 nA. The resistance of the resistance element is so selected in this embodiment as to satisfy the following relationship.

$$Vth-Vr=2-0.5=1.5\ V$$

In the case of an element size of 100 $\mu$m square, the electric capacitance of an ordinary organic EL element is about 2.5 pF. Therefore, the time t that has to be spent before the start of light emission is determined by the following expression of $$t=1.5\ V\times2.5\ pF/100\ nA=37.5\ \mu s,$$

which represents a significant reduction of the charging time.

FIG. 1B shows a circuit formed by using a switching element, which is a TFT whose channel length L and the channel width W are so regulated as to make it show a resistance equal to and operate as the resistance element. To select an appropriate TFT, it is only necessary to observe the current-voltage characteristic of the TFT having a certain W/L ratio and determine the size of the TFT on the basis of the observed characteristic.

Embodiment 2

Figure 2:
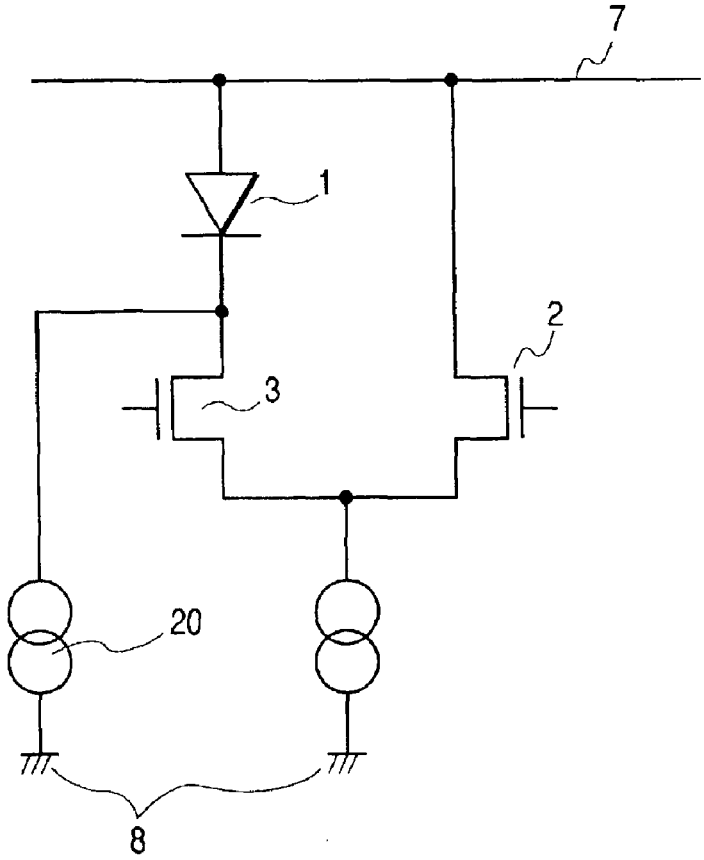
FIG. 2 is a circuit diagram of the second embodiment of the invention.

FIG. 2 is a circuit diagram of the second embodiment of the invention showing the pixel circuit related to it. This embodiment is additionally provided with a constant current circuit 20 for causing a bias current to flow through an organic EL element 1 for high speed operation. The first electrode and the second electrode of the constant current circuit 20 are connected respectively to the cathode of the organic EL element 1 and a grounding line 8. The constant current circuit 20 and the organic EL element 1 are connected in series between a power supply line 7 and the ground potential 8 and the constant current circuit 20 operates to limit the bias current flowing through the organic EL element to a value that reduces the brightness of emitted light to less than a predetermined level, a fraction of the lowest brightness for example. With this arrangement, the bias current is held to a level lower than that of the electric current that can produce the lowest brightness of emitted light for the organic EL element 1 and utilized to precharge the electric capacitance of the organic EL element 1. It is necessary to turn the TFT 2 OFF and the TFT 3 ON in order to cause the light-emitting element to emit light.

Thus, the voltage and the electric current necessary for producing the proper brightness of emitted light can be supplied in a short period of time by precharging the electric capacitance of the organic EL element in this way.

Embodiment 3

Figure 3:
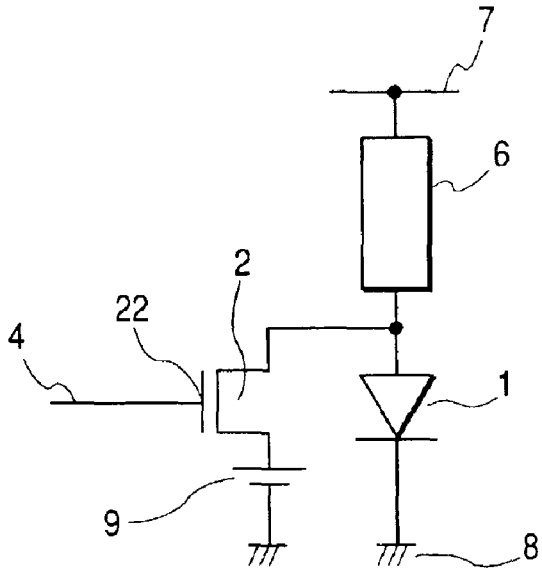
FIG. 3 is a circuit diagram of the third embodiment of drive circuit to be used in an active matrix type light-emitting element array according to the invention.

FIG. 3 is a third embodiment of drive circuit to be used in an active matrix type light-emitting element array according to the invention.

The drive circuit of this embodiment is so designed as to be used in an active matrix type light-emitting element array comprising scan lines (not shown) and signal lines 4 arranged to form a matrix on a substrate and unit pixels arranged near the respective crossings of the scan lines and the signal lines, each unit pixel having a picture signal current supply circuit 6 and a light-emitting element 1 adapted to be caused to emit light by the picture signal current.

As shown in FIG. 3, one of the electrodes of the organic EL element 1 is commonly connected to the source electrode of the TFT 2 as viewed from the power supply line 7, while the other electrode of the organic EL element 1 is connected to the ground potential 8 that operates as power source. The drain electrode of the TFT 2 is connected to a reference voltage source 9. The source electrode of the TFT 2 that is commonly connected to the organic EL element 1 is also connected to the output of a current supply circuit 6 for supplying a picture signal current to the organic EL element 1.

With this arrangement, it may be needless to say that the junction capacitance of the light-emitting element is precharged by the reference voltage source 9. The voltage of the reference voltage source 9 is lower than the light-emitting threshold voltage of the organic EL element as described above so that it does not participate in any display operation.

Unlike the first and second embodiments, it is not necessary to constantly cause an electric current (electric load) to flow for the purpose of precharging in this embodiment so that, consequently, this embodiment provides an advantage of reducing the overall power consumption rate. More specifically, the precharging operation may be conducted at any time before the time when a picture signal current is actually made to flow to the organic EL element. In the case of a matrix type display device, for example, it may be conducted immediately before each necessary scan line is selected for transferring a picture signal or during a blanking period of a picture display period.

In this embodiment, since the voltage of the reference power source is Vref=1.5 V (assuming Vth=2 V), the time tp required for precharging the junction capacitance is obtained by the following equation.

$$tp=1.5\times 2.5\ pF/Id$$

The conductance of the TFT 2 is so selected as to make it possible to cause an electric current of about 10 $\mu$A to flow by regulating the size of the TFT 2 and the voltage of the signal line 4. Therefore, the time tp required for precharging by way of the TFT 2 is $$tp=1.5\times 2.5\ pF/10\ \mu A=375\ \text{ns}.$$

It is a very short period of time and hence does not affect the actual display time at all.

Embodiment 4

Figure 4:
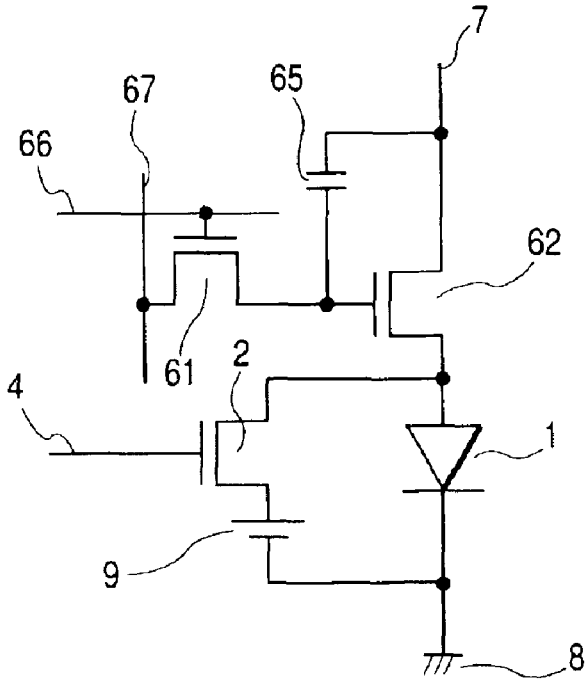
FIG. 4 is a circuit diagram of the fourth embodiment of drive circuit to be used in an active matrix type light-emitting element array according to the invention.

FIG. 4 is a circuit diagram of the fourth embodiment of drive circuit to be used in an active matrix type light-emitting element array according to the invention. This embodiment is realized by adding a source follower circuit comprising a TFT to the current supply circuit of FIG. 3. In FIG. 4, the components same as those of FIG. 3 are denoted respectively by the same reference symbols.

This embodiment of drive circuit comprises a TFT 61 to be selected by means of a scan line 66 and a data line 67, a memory capacitance 65 and a TFT 62 of the source follower circuit. In other words, the current supply circuit includes a source follower circuit that comprises the TFT 62.

This circuit is identical with the known drive circuit illustrated in FIG. 7 in terms of basic configuration. It differs from the known circuit in that the output of the TFT 62 of the source follower circuit is connected not only to the organic EL element 1 but also commonly to the TFT 2 that is connected to the reference voltage source 9.

In this embodiment again, as in the third embodiment, it is possible to make the drive circuit show a response performance satisfactory for the pulse width modulation display using a high gray-scale level of 8 bits by providing a precharge circuit comprising a reference voltage source 9 and a TFT 2.

Embodiment 5

Figure 5:
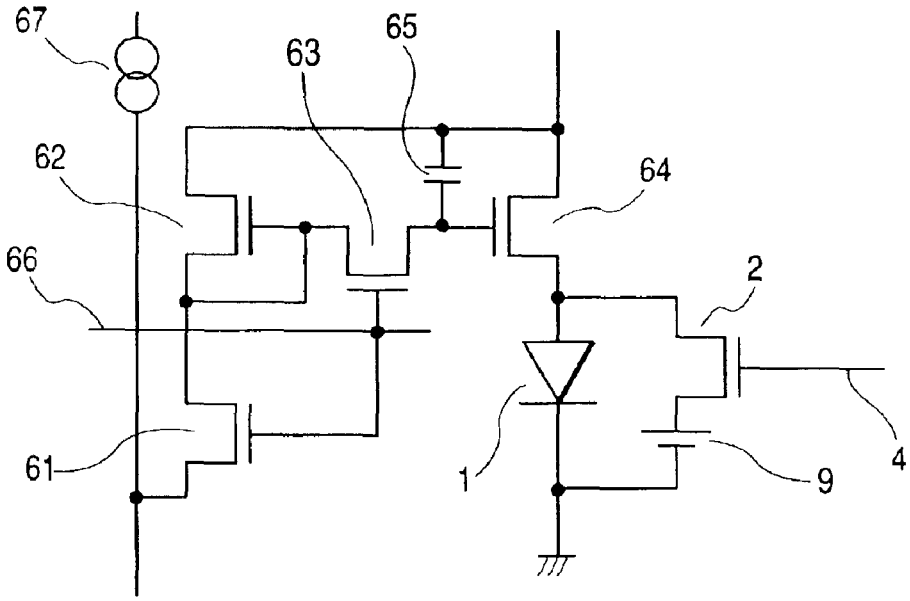
FIG. 5 is a circuit diagram of the fifth embodiment of drive circuit to be used in an active matrix type light-emitting element array according to the invention.

FIG. 5 is a circuit diagram of the fifth embodiment of drive circuit to be used in an active matrix type light-emitting element array according to the invention. This embodiment is realized by using a current mirror circuit comprising a TFT for the current supply circuit of FIG. 3. In FIG. 5, the components same as those of FIG. 3 are denoted respectively by the same reference symbols.

This embodiment of drive circuit comprises a TFT 61 to be selected by means of a scan line 66 and a data line 67, a memory capacitance 65, a TFT 64 of the current mirror circuit, a TFT 62 having one of the electrodes connected to the memory capacitance 65 and the other electrode connected to one of the electrodes of the TFT 61 and another TFT 63 having one of the electrodes connected to the memory capacitance 65 and the other electrode connected to the control electrode of the TFT 62. In other words, the current supply circuit includes a current mirror circuit comprising a TFT 64. This part of the circuit is identical with the drive circuit adapted to the analog gray-scale system as disclosed in Japanese Patent No. 2,953,465.

This embodiment differs from the cited known drive circuit in that the output of the TFT 64 of the current mirror circuit is connected not only to the light-emitting element 1 but also commonly to the TFT 2 that is connected to the reference voltage source 9.

The precharging function of this embodiment realized by the TFT 2 is similar to that of the above described circuit. With the provision of the precharge circuit, it is possible to make the drive circuit show a high speed response performance satisfactory for constant current drive in low brightness display operations.

Embodiment 6

Figure 6:
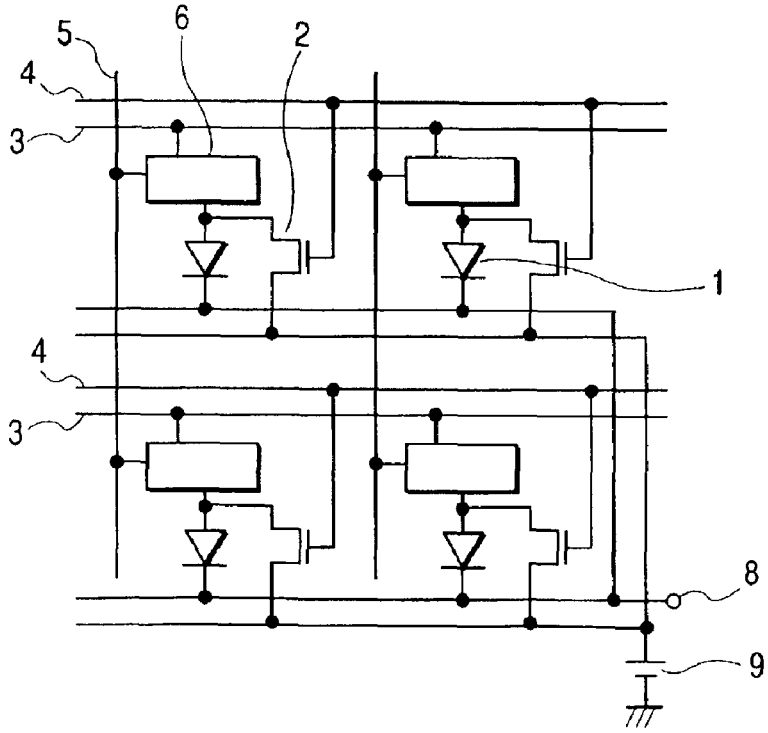
FIG. 6 is a circuit diagram of drive circuits of an active matrix type display panel according to the invention. In FIG.

FIG. 6 is a circuit diagram of an embodiment of the invention, which is an active matrix type display panel. While FIG. 6 shows a 2×2 matrix circuit for the purpose of simplification, it may be clear that the number of rows and that of columns are not subject to any limitation. The illustrated display panel comprises a plurality of pixel sections arranged in the form of matrix and respectively including drive circuits, each of which may have the configuration of any of the first through fifth embodiments, and organic EL elements. Note that, in FIG. 6, drive circuits having the configuration of the third embodiment are arranged in the form of matrix.

As a scan line 3 is selected, a picture signal is transferred to it from a picture signal line 5 and a signal current is supplied from the selected picture signal current supply circuit 6 to the corresponding organic EL element 1 according to the signal. Prior to the selection of the scan line, the signal line 4 corresponding to the same pixel is selected and the corresponding TFT 2 is turned ON to precharge the organic EL element 1. The same operation will be repeated before the selection of the next scan line 3. In this way, the matrix type display panel is driven to operate for displaying an image.

While the organic EL element 1 is precharged immediately before the selection of the pixel in this embodiment, it is not necessary that the precharge takes place immediately before the selection. Alternatively, the operation of precharging the succeeding row may be conducted during the time period when the operation of selecting the preceding row is taking place. Still alternatively, it may be conducted during the blanking period of the picture signal period. However, it is better to precharge the organic EL element immediately before the selection of the pixel as in this embodiment from the viewpoint of reducing the power consumption.

A picture signal current supply circuit 6 as described above by referring to the fourth and fifth embodiments may be used for this embodiment. When a pulse width modulation system type drive circuit as described above by referring the third embodiment is employed, there may arise an apprehension that the display period is further reduced by it. However, the time required for a precharging operation is only sub-micro seconds and no problem actually occurs.

This embodiment of active matrix type display panel is realized by using drive circuits having a configuration same as that of the third embodiment. Alternatively, this embodiment of active matrix type display panel can be realized by using drive circuits having a configuration same as that of the first embodiment so that a precharging current always flows to the entire display panel because of the use of resistance elements 2. However, since the precharging current is very minute and hence it does not significantly affect the power consumption rate. This arrangement provides an advantage that the display panel can be manufactured in a relatively simple way because it comprises only resistance elements and it is not necessary to prepare TFTs.

As described above, a voltage lower than the light-emitting threshold voltage of a light-emitting element is applied to the element prior to a light-emission of the element by means of a drive circuit according to the invention so as to reduce the time to be consumed before the emission of light. As a result, the light-emitting element can start emitting light within a given selection period. Therefore, it is possible to provide a display panel that can display high quality moving images particularly in terms of gray-scale by using drive circuits according to the invention.

What is claimed is:

1. A drive circuit to be used in an active matrix type light-emitting element array having scan lines and signal lines arranged in a matrix form on a substrate, at least a light-emitting element and a picture signal electric current supply circuit for causing the light-emitting element to emit light being provided near each of the crossings of the scan lines and the signal lines, said drive circuit comprising:

a charging circuit adapted to apply a voltage and/or an electric current to said light-emitting element, said voltage being lower than a light-emitting threshold voltage of the light-emitting element, said electric current being lower than a lowest brightness producing electric current of the light-emitting element.

2. The circuit according to claim 1, wherein said voltage lower than a light-emitting threshold voltage is a partial voltage of a power source voltage produced by division by a resistance element or a switching element and the light-emitting element.

3. The circuit according to claim 2, wherein said switching element is a thin film transistor.

4. The circuit according to claim 1, wherein said electric current lower than a lowest brightness producing electric current is produced by a limiting resistance of a resistance element or a switching element relative to a power source voltage.

5. The circuit according to claim 4, wherein said switching element is a thin film transistor.

6. The circuit according to claim 1, wherein charging operation of said charging circuit is conducted in a non-light-emitting period of said light-emitting element.

7. The circuit according to claim 1, wherein charging operation of said charging circuit is conducted both in a light-emitting period and in a non-light-emitting period of said light-emitting element.

8. The circuit according to claim 1, wherein said charging circuit is formed by using a switching element and a reference voltage source.

9. The circuit according to claim 1, wherein said picture signal current supply circuit includes a source follower circuit formed by using a thin film transistor.

10. The circuit according to claim 1, wherein said picture signal current supply circuit includes a current mirror circuit formed by using a thin film transistor.

11. An active matrix type display panel comprising a plurality of pixel sections arranged in a matrix form, each of said plurality of pixel sections including a drive circuit according to claim 1, a light-emitting element being provided in each of said plurality of pixel sections.

12. A method of driving an active matrix type light-emitting element array, charging operation of the charging circuit as defined in claim 1 being conducted in a non-light-emitting period of the light-emitting element.

* * * * *